United States Patent [19]

Sjöström et al.

[11] Patent Number: 4,944,841

[45] **Date of Patent: * Jul. 31, 1990**

[54] PROCEDURE FOR CONTROLLING ALKALINE PULPING PROCESSES

[75] Inventors: Eero Sjöström; Alén Raimo, both of Helsinki, Finland

[73] Assignee: Kajaani Elektroniikka Oy, Finland

[ * ] Notice: The portion of the term of this patent subsequent to Aug. 1, 2006 has been disclaimed.

[21] Appl. No.: 181,825

[22] Filed: Apr. 15, 1988

[51] Int. Cl.[5] ..... D21C 3/02; D21C 7/12

[52] U.S. Cl. ..... 162/49; 162/61

[58] Field of Search ..... 162/60, 61, 49, 198, 162/238, DIG. 10, 62

[56] References Cited

U.S. PATENT DOCUMENTS 4,853,084 8/1989 Alen et al. ..... 162/49

OTHER PUBLICATIONS

Kleinert et al., "Short Wavelength Ultraviolet Absorption of Alkali-Lignin . . . " *Tappi*, vol. 41 (7), p. 372, 7-1958.

Kleinert et al., "Short Wavelength Absorption of Various Lignins and Related Substances"; *Pulp and Paper Canada*, p. 154, 4-1957.

Arunovic et al. "Determination of Low Molecular Weight Organic Acids in Pulping Liquors" *Tappi*, vol. (54), 10, p. 1963; 10-1971.

*Primary Examiner*—Steve Alvo

*Attorney, Agent, or Firm*—Andrus, Sceales, Starke & Sawall

[57] ABSTRACT

A procedure for monitoring alkaline delignification, in particular kraft cooking, of wood or other cellulosic material with the aid of the mutually relative concentrations of the monomeric lignin hydration products which are formed in connection therewith and are dissolved in the spent liquor. According to the procedure, a sufficient number of representative spent liquor samples is taken during the cooking process which are analyzed by gas chromatography. On the basis of the concentration proportions of certain compounds which have been analyzed, that time period is determined in each instance which is required to reach the desired degree of delignification.

4 Claims, 2 Drawing Sheets

PROCEDURE FOR CONTROLLING ALKALINE PULPING PROCESSES

The present invention concerns a procedure for monitoring alkaline pulping processes, in particularly pine and birch kraft cooling processes, utilizing the relative composition of the monomeric products that have been dissolved in the cooking liquor and originate from lignin as a result of degradation.

BACKGROUND OF THE INVENTION

According to the earlier Finnish patent application No. 850208, a similar monitoring of the cooking process is based on an indirect procedure, by following the development of the proportion of aliphatic acids originating from the carbohydrate material in the wood and dissolved in the cooking liquor, said proportion in its turn bearing a relation to the dissolving of lignin. The procedure of the present invention is based on those regularities which have now been detected in the degradation of lignin, and on the means by which these degradation products can be analysed during the cooking process.

It is known in the art that when in alkaline cooking processes the lignin present in the wood is removed, part of the carbohydrate material in wood is also degraded (Sjöström, E., Wood Chemistry, Fundamentals and Applications, Academic Press, New York, 1981). The organic matter dissolved in the spent liquor is thus composed not only of lignin fragments but also of carbohydrate degredation products and extractives from the wood. The lignin fraction of the spent liquor, in turn, is rather heterogeneous, consisting of various-sized molecules, part of which are in the monomer stage (Gierer, J. & Lindberg, O., Acta Chem. Scand. B 34(3) (1980)161, and Niemelä, K. & Sjöström, E., Holzforschung 40(1986)361). Said monomers are mainly phenol derivatives having a structure with a varying number and position of the groups substituted in the benzene ring. The formation of said monomeric phenols is essentially influenced by the cooking conditions applied in each instance, and by the raw material which is used. Thus, for instance, when birch wood is being cooked, also partly different lignin decomposition products are formed from those resulting when softwood is similarly cooked.

SUMMARY OF THE INVENTION

In the present invention a novel and unexpected observation has now been made, to the effect that the quantity of the monomeric degradation products mentioned above changes in the course of cooking in a regular way, so that on the basis of their concentrations the cooking time required for reaching a given degree of delignification can be predicted. The degradation products can be analysed during the cooking process, and on the basis of their quantities the cooking process can thus be monitored. Cooking-process monitoring methods have been presented heretofore which are based on the total lignin concentration. Although the lignin concentration of spent liquor can be determined by ultraviolet spectrophotometry, no accurate procedure serving determination of the endpoint of the cook can be based thereon because the increase of total lignin concentration is too small, toward the end of the cook, relative to the accuracy of measurement (cf. Sjöström, E. & Haglund, P., Tappi 47(1964)280). The procedure here presented is based on a completely new and novel idea, which as a further advantage displays the observed fact that, once a given delignification limit has been passed, the ratio of the concentrations of those compounds which are analysed increase by a jump. The main characteristic features of the invention are readable in the claims following farther below.

In the course of elaborating the procedure of the invention detailed cooking liquor and pulp analyses had to be made during the cooking process. These analyses particularly had to do with the determinations of the contents of phenol monomers originating from lignin. It was unexpectedly found that between the mutually relative concentrations (or the concentration proportions) of said compounds and the total cooking yield (or alternatively the amount of lignin remaining in the raw material) there exists an arithmetic relationship which depends on the degree of delignification. When samples are withdrawn during cooking at given intervals (e.g. toward the end of the heating-up period, or immediately thereafter), it becomes possible on the basis of the contents of the products to determine the period of time which is required for a given degree of delignification to be reached.

A prerequisite for a succesfull application of the procedure is, that the lignin degradation products which are formed can be separated from each other and analysed with adequate accuracy. The contents of monomeric phenol derivatives are determinable comparatively fast from the acidified spent liquor by chromatographic methods, e.g., by gas chromatography after other extraction from the separated fraction (Alén, R., Niemelä, K. & Sjöström, E. I, Chromatogr., 301(1984)273, and Niemelä, K. & Sjöström, E., Holzforschung 40(1986)361), the compounds being mutually separated as such or in the form of separately prepared trimethylsilyl derivatives. The respecitve concentrations (based on the areas of the chromatographic peaks in the output); the cooking-process monitoring information calculable therefrom will be obtained immediately, utilizing computer technology. If a gas chromatographic technique is applied, the temperature of the capillary column is so adjusted that a good resolution of the peaks corresponding to the phenol derivatives with significant concentration is achieved. Determination of the requisite delignifying time may be based on monitoring the change of the mutually relative concentrations of the said phenols during the cooking process.

DESCRIPTION OF THE PREFERRED EMBODIMENT

The procedure on which the invention is based shall be more closely illustrated in the examples following below. Although only pine and birch kraft cooking is considered in them, it is self-evident that the procedure is equally applicable in the case of other alkaline cooking processes (e.g. in soda-anthraquinone cooking) and of other raw materials, provided that the relative formation, related to the total cooking yield and to the degree of delignification, of said lignin monomers is first similarly determined in each instance. Since partly different lignin decomposition products are formed from softwood and from hardwood, the procedure is moreover applicable in connection with so-called mixed cooking processes in which softwood as well as hardwood chips are changed into the digester.

EXAMPLE 1

Extractive-free chips (screened fraction 2–4 mm) made from pine wood (*Pinus sylvestris*) was subjected, in a laboratory digester to standard kraft cooking (active alkali, 22% (as NaOH) of the wood); sulphidity 30%), with a liquor/wood ratio of 4 L/kg. The cooking temperature was raised at a constant rate in 90 minutes from 20° C. to 175° C., and the cook was continued for 90 min. at the maximum temperature. During its course spent liquor samples were taken at certain intervals (90 min.), which were analysed for the relative composition of the fraction containing monomeric lignin derivatives.

Figure 1:
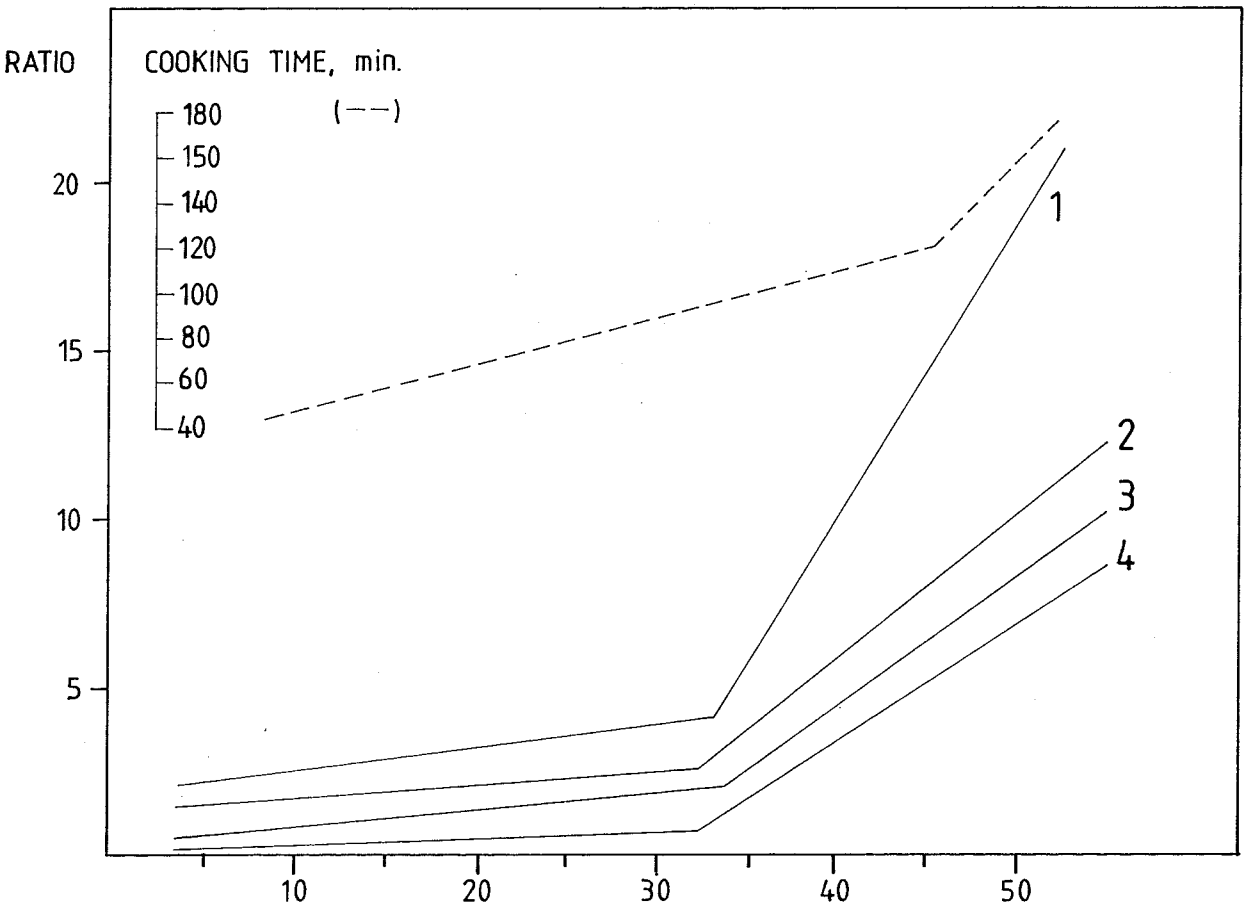
FIG. 1 is a graph showing the relative concentrations of monomeric lignin derivatives produced in pine Kraft cooking and dissolved in waste liquor as a function of the matter dissolved in the cooking process.

FIG. 1 shows the relationship of relative contribution ratios, formed with the aid of selected derivatives, with the total yield of cooking achieved in the respective period. So FIG. 1 shows the change of mutually relative concentrations of certain monomeric lignin derivatives produced in the pine kraft cooking process and dissolved in the waste liquor (0–20), presented as a function of the matter dissolved in the cooking process (5–50%). Proportions: 1 (acetovanilone+vanillin)/(vanillic acid)-, 2 (vanillin)/(vanillic acid)-, 3 (acetovanillone)/(vanillic acid)-, and 4 (aceto-,(vanillone)/coniferyl-alcohol+vanillic acid)-. The time elapsed for delignification is furthermore presented in connection with the results. As has been reported in said earlier patent application (FI 850208), the total yield is in turn dependent on the chlorine number, from which the lignin quantity remainig in the pulp can be calculated in each case.

By taking a sufficient number of spent liquor samples (4–6 samples) from a similar cook carried out with the respective digester, toward the end of the heating-up period and immediately thereafter, it is made possible, using the said information, to determine by mathematical means (continuous comparison, during progress of the cooking process, of the results with those of the model cooking process) that period of time in which the desired degree of delignification will be reached. It is also possible of course, that other monomer proportions are selected to constitute the base of consideration. For gas chromatographic analysis, the lignin fraction was extracted with ether from the spent liquor samples acidified with mineral acid (pH brought down below 3), and said fraction was analysed as demonstrated by the references cited above. It is, however, possible to speed up the gas chromatographic temperature programme substantially if required, without incurring any impairment of peak resolution worth mentioning. The identification of compounds was furthermore confirmed by means of mass spectrometry and by using model substances.

EXAMPLE 2

Figure 2:
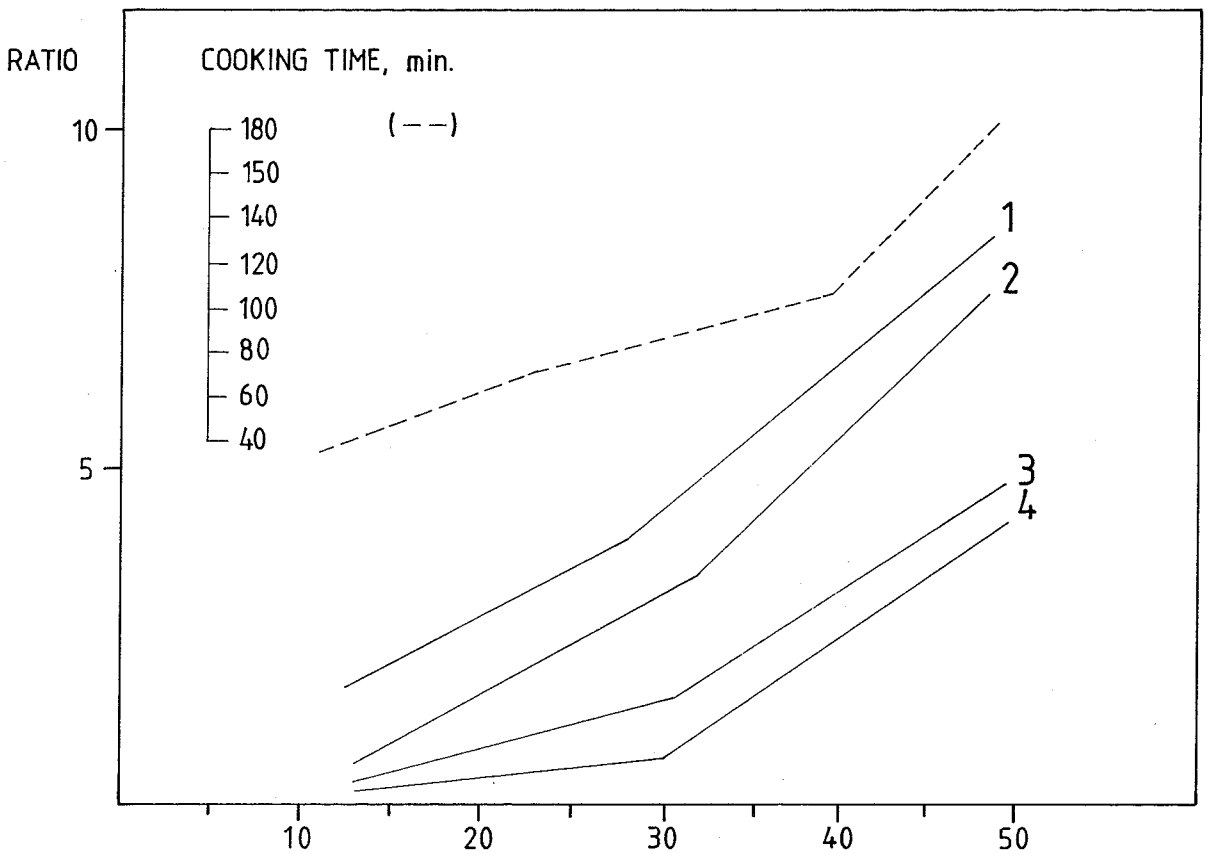
FIG. 2 is a graph showing the relative concentrations of monomeric lignin derivatives produced in birch Kraft cooking and dissolved in waste liquor as a function of the matter dissolved in the cooking process.

A similar kraft cook as in Example 1 (active alkali 20% (as NaOH) of the wood; sulphidity 30%; and liquor/wood proportion 4 L/kg) was run with extractive-free chips (screened fraction 2–4 mm) made from birch wood (*Betula verrucosa/B. pubescens*), the temperature of the batch being raised at uniform rate from 20° C. to 165° C. FIG. 2 shows in this particular case, the proportions required with a view to monitoring the cooking process, based on mutual relative concentrations of the selected compounds. So FIG. 2. shows the change of mutually relative concentrations of certain monomeric lignin derivatives produced in the birch kraft cooking process and dissolved in the waste liquor (0–10), presented as a function of the matter dissolved in the cooking process (5–50%). Proportions: 1 (acetosyringone+dihydrocboniferyl) alcohol)/(vanillic acid)-, 2 (acetosyringone)/(vanillic acid)-, 3 (acetosyringone)/(acetovanillin)-, and 4 (acetosyringon)/(acetovanillin+sinapyl alcohol)-. In this instance, too, the yield is dependent on the chlorine number, as disclosed before, whereby it becomes possible in each case to calculate the residual lignin content of the pulp. The conditions relating to the taking and preparation of samples and to their analysis were as in Example 1.

We claim:

1. A method of controlling an alkaline pulping process, comprising the steps of pulping cellulose material with an alkaline cooking liquor in a pulping process, said process being selected from the group consisting of a sulfate process, and a soda anthraquinone process, determining at a plurality of time intervals the concentration ratios of at least two different monomeric degradation compounds of lignin formed during the pulping wherein the ratios change at various times during the pulping, and terminating the pulping when a predetermined concentration ratio of said two compounds is reached.

2. The method of claim 1, and including the step of separating and analyzing the monomeric compounds by a chromatography procedure selected from the group consisting of high pressure liquid chromatography or gas chromatography.

3. The method of claim 1, and including the step of analyzing said monomeric compounds in the form of their trimethylsilyl derivatives.

4. The method of claim 1, wherein said monomeric compounds are selected from the group consisting of acetovanillone, vanillin, vanillic acid, coniferyl alcohol, acetosyringone, dihydroconiferyl alcohol, and sinapyl alcohol.

* * * * *

UNITED STATES PATENT AND TRADEMARK OFFICE

CERTIFICATE OF CORRECTION

PATENT NO. : 4,944,841

DATED : July 31, 1990

INVENTOR(S) : EERO SJÖSTRÖM ET AL

It is certified that error appears in the above-identified patent and that said Letters Patent is hereby corrected as shown below:

Title page:

At "[75] Delete "Alén Raimo" and substitute therefor --Raimo Alén--

Signed and Sealed this

Seventh Day of January, 1992

*Attest:*

*Attesting Officer*

HARRY F. MANBECK, JR.

*Commissioner of Patents and Trademarks*